US010992067B2

(12) United States Patent
Geske et al.

(10) Patent No.: US 10,992,067 B2
(45) Date of Patent: Apr. 27, 2021

(54) CONNECTION DEVICE FOR CONNECTION OF AN ELECTRICAL LINE

(71) Applicant: Phoenix Contact GmbH & Co. KG, Blomberg (DE)

(72) Inventors: Ralf Geske, Schieder-Schwalenberg (DE); Sergej Eremin, Herford (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/629,983

(22) PCT Filed: Jun. 25, 2018

(86) PCT No.: PCT/EP2018/066912
§ 371 (c)(1),
(2) Date: Jan. 10, 2020

(87) PCT Pub. No.: WO2019/011635
PCT Pub. Date: Jan. 17, 2019

(65) Prior Publication Data

US 2020/0136276 A1 Apr. 30, 2020

(30) Foreign Application Priority Data

Jul. 14, 2017 (BE) ..... 2017/5499

(51) Int. Cl.
*H01R 4/48* (2006.01)
*H01R 4/40* (2006.01)
*H01R 9/24* (2006.01)

(52) U.S. Cl.
CPC ..... *H01R 4/4836* (2013.01); *H01R 4/40* (2013.01); *H01R 4/4845* (2013.01); *H01R 9/24* (2013.01)

(58) Field of Classification Search
CPC .. H01R 4/4818; H01R 4/4827; H01R 4/4836; H01R 4/40; H01R 4/4845; H01R 9/24
(Continued)

(56) References Cited

U.S. PATENT DOCUMENTS 6,045,382 A 4/2000 Sano et al.
8,113,858 B1 2/2012 Chiang
(Continued)

FOREIGN PATENT DOCUMENTS

CN 1902790 A 1/2007
CN 100593883 C 3/2010
(Continued)

*Primary Examiner* — Gary F Paumen
(74) *Attorney, Agent, or Firm* — Leydig, Voit & Mayer, Ltd.

(57) ABSTRACT

A connection device for connection of an electrical conductor includes: a housing which has an insertion opening for insertion of an electrical conductor; a spring element arranged on the housing, which spring element has a spring leg for locking a conductor inserted in the insertion opening; and an adjusting element which is arranged adjustably on the housing. By adjustment of the adjusting element, the spring leg is movable between a clamping position in which a conductor inserted in the insertion opening is lockable in the insertion opening, and a release position in which a conductor may be inserted into the insertion opening, or a conductor inserted in the insertion opening is releasable from the insertion opening. The spring element has an actuation section arranged on the spring leg on which the adjusting element acts during an adjustment for the movement of the spring leg.

11 Claims, 4 Drawing Sheets

(58) Field of Classification Search
USPC ..... 439/441
See application file for complete search history.

(56) References Cited

U.S. PATENT DOCUMENTS

| | | | | |
|---|---|---|---|---|
| 8,794,994 | B2 * | 8/2014 | Kollmann | H01R 4/4836 439/441 |
| 9,124,034 | B2 * | 9/2015 | Kollmann | H01R 13/627 |
| 9,413,085 | B2 * | 8/2016 | Hoppmann | H01R 4/4836 |
| 10,164,349 | B2 * | 12/2018 | Koellmann | H01R 4/4836 |
| 2007/0044404 | A1 | 3/2007 | Shimada et al. | |
| 2013/0029529 | A1 | 1/2013 | Osagie et al. | |
| 2018/0248276 | A1 | 8/2018 | Kettern | |
| 2018/0254568 | A1 | 9/2018 | Koellmann | |

FOREIGN PATENT DOCUMENTS

| | | | |
|---|---|---|---|
| CN | 103703623 | B | 8/2016 |
| DE | 202009007573 | U1 | 10/2010 |
| DE | 102015115612 | A1 | 3/2017 |
| DE | 102015119247 | A1 | 5/2017 |
| TW | 368764 | B | 9/1999 |

* cited by examiner

CONNECTION DEVICE FOR CONNECTION OF AN ELECTRICAL LINE

CROSS-REFERENCE TO PRIOR APPLICATIONS

This application is a U.S. National Phase application under 35 U.S.C. § 371 of International Application No. PCT/EP2018/066912, filed on Jun. 25, 2018, and claims benefit to Belgian Patent Application No. BE 2017/5499, filed on Jul. 14, 2017. The International Application was published in German on Jan. 17, 2019 as WO 2019/011635 under PCT Article 21(2).

FIELD

The invention relates to a connection device.

BACKGROUND

Such a connection device serves for the connection of an electrical line. Such a connection device can be used, for example, on an electrical installation, a switchgear cabinet or another electrical assembly, such as a printed circuit board or the like, in order to electrically connect an electrical conductor by inserting the conductor into an insertion opening.

Such a connection device comprises a housing, which has an insertion opening for inserting an electrical conductor, and a spring element arranged on the housing, which spring element has a spring leg for locking a conductor inserted into the insertion opening. An adjusting element is adjustably arranged on the housing such that, by adjusting the adjusting element, the spring leg can be moved between a clamping position in which a conductor inserted into the insertion opening can be locked in the insertion opening, and a release position in which a conductor can be inserted into the insertion opening or a conductor inserted into the insertion opening can be released from the insertion opening.

In conventional connection devices of this type, it can be provided that the slide element is to be acted upon by means of a tool in order thereby to adjust the spring leg of the spring element. This may require a user to hold the connection device and any electrical conductor to be attached, as well as the tool, in his hands simultaneously and to actuate them, which can be cumbersome and impractical.

There is therefore a need for a connection device which allows easy handling by a user, especially for inserting an electrical conductor or for releasing an electrical conductor from the connection device.

In a connection device known from U.S. Pat. No. 8,113,858, a spring element is arranged in a housing and can be adjusted by a manually operable slider element. The slider element is designed to act on the spring element in order to enable a conductor to be plugged in, wherein the spring element locks the electrical conductor on the housing in an electrically contacting manner after the conductor has been attached and after the slider has been retracted.

In a connection device known from DE 20 2009 007 573 U1, a slide element is provided which is adjustable for adjusting a spring leg of a spring element.

In a connection device known from DE 10 2015 115 612 A1 in the form of a connecting terminal, a connecting element is formed on a spring leg of a spring element via which the spring leg is coupled to an actuation element in the form of a pivot lever such that the spring leg can be pulled out of a clamping position in the direction of a release position by pivoting the actuation element.

In the connection device known from DE 10 2015 115 612 A1, the connecting element is formed integrally with the spring leg by bending the spring element made as a punch part from spring steel. Also depending on the rolling direction of the spring steel, a relatively large bending radius can also be required for such a bend, which can increase the installation space of the spring element.

SUMMARY

In an embodiment, the present invention provides a connection device for connection of an electrical conductor, comprising: a housing which has an insertion opening for insertion of an electrical conductor; a spring element arranged on the housing, which spring element has a spring leg configured to lock a conductor inserted in the insertion opening; and an adjusting element which is arranged adjustably on the housing, wherein by adjustment of the adjusting element, the spring leg is movable between a clamping position in which a conductor inserted in the insertion opening is lockable in the insertion opening, and a release position in which a conductor may be inserted into the insertion opening, or a conductor inserted in the insertion opening is releasable from the insertion opening, wherein the spring element has an actuation section arranged on the spring leg on which the adjusting element is configured to act during an adjustment for the movement of the spring leg, and on which a support section is formed which is configured to bear against the spring leg at a support point when the spring leg is moved.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
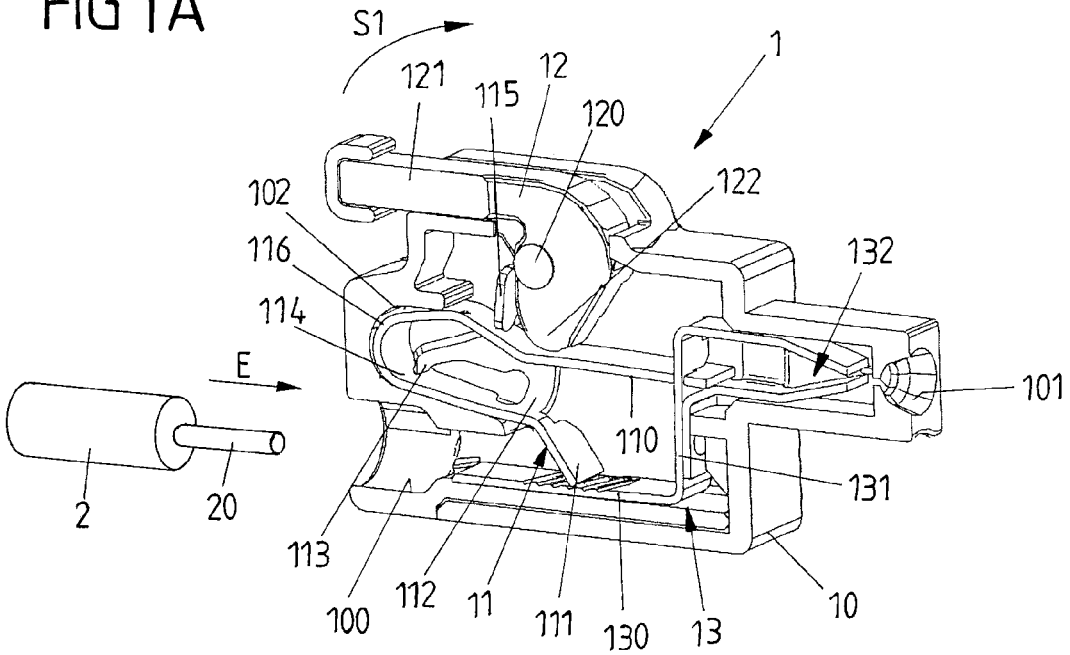
FIG. 1A a perspective view of a connection device for connecting an electrical conductor to a spring element in a clamping position.
Figure 1B:
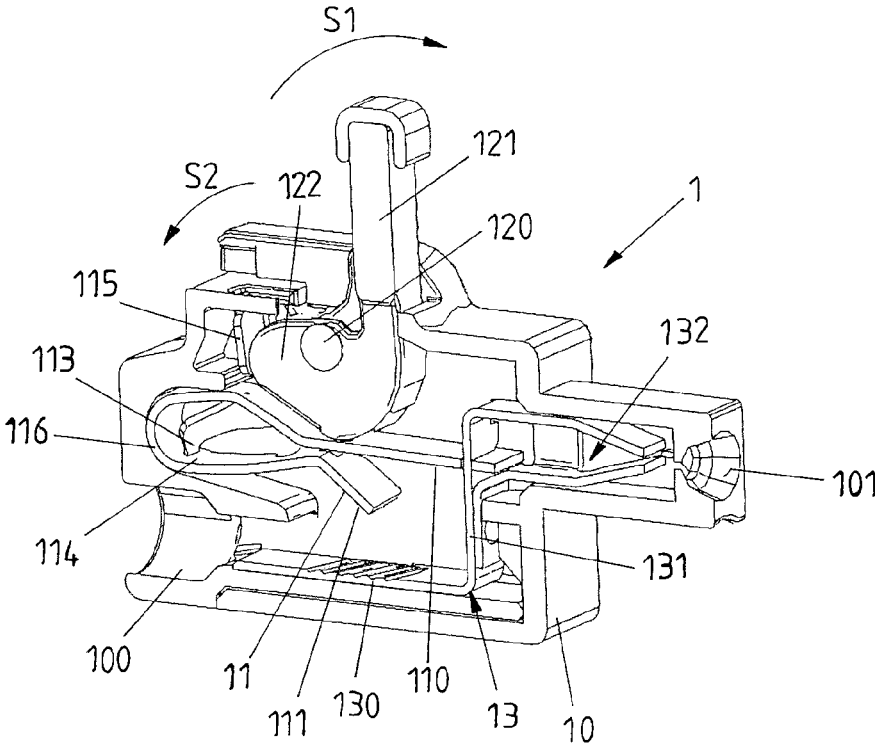
FIG. 1B the view according to FIG. 1A with the spring element in a release position.

In an embodiment, the present invention provides a connection device for the connection of an electrical conductor which can easily be actuated for adjusting a spring element between a clamping position and a release position, with easy manufacturability of the spring element and with favorable loading capacity, even with repeated actuation during operation.

Accordingly, the spring element has an actuation section which is arranged on the spring leg and on which the adjusting element acts during an adjustment for moving the spring leg, and on which a support section is formed which is designed to bear against the spring leg at a support point when the spring leg is moved.

The adjustment of the spring leg can be effected by actuation of the adjusting element. In this case, the adjusting element acts on the actuation section formed on the spring leg in order to apply thereby an adjusting force to the spring leg and to adjust the spring leg.

In order to specify a defined pivot axis for adjusting the spring leg, the support section is formed on the actuation section. The support section is designed to bear against the spring leg when the spring leg is moved so that the support section presses on the spring leg and thereby creates a defined pivot point for the spring leg.

Due to the fact that a defined pivot point is created on the spring leg by means of the support section and can preferably be located in a loadable region of the spring leg, the load on the spring leg occurs during bending at a defined location in a defined manner so that the load in other regions of the spring leg can be reduced, thus enabling a reduction in the dimensioning of the spring leg in other regions.

In particular, the spring leg can be dimensioned with a reduced cross section at the location at which the actuation section extends from the spring leg, which makes it possible to keep the installation space of the spring element small—despite a large bending radius which may be required at the transition between the spring leg and the actuation section.

The adjusting element can be designed especially to act on the actuation section in order to move the spring leg in the direction of the release position. By adjustment of the adjusting element, the spring leg can thus be transferred from its clamping position into the release position by the adjusting element acting on the actuation section, for example by pressing on the actuation section or pulling on the actuation section, so that the spring leg is thereby moved. When the adjusting element is adjusted, the spring leg is preferably pivoted relative to the housing about a pivot axis pointing through the support point, so that the spring leg executes a defined pivoting movement when the adjusting element is actuated.

In one embodiment, the support section does not bear against the spring leg when the spring element is in the clamping position. Only when the spring leg is moved, which is caused by an adjustment of the adjusting element, does the support section bear against the spring leg at the support point, so that the spring leg can be pivoted out of the release position in the direction of the clamping position about a defined pivot axis which points through the support point.

In one embodiment, the actuation section is integrally formed with the spring leg. The spring element can in particular be produced as a whole from spring steel. In this case, the actuation section is preferably formed by bending at the spring leg. This results in a simple, economical manufacturability of the spring element, with integral, one-piece shaping of the spring leg with the actuation section and the supporting section formed thereon.

In one embodiment, the spring element has a retaining leg which is attached to the spring leg. The spring element is supported relative to the housing via the retaining leg, for example by the retaining leg engaging with a current bar which holds the retaining leg in position within the housing.

The current bar can, for example, form a contact section for contact with a conductor inserted into the insertion opening. The current bar may have an L-shape with a base relative to which the contact section is transversely extended. In this case, a terminal for the connection of a plug-in connector for electrical contact can also be formed on the base with a line connected to the connection device.

The retaining leg may, for example, be bent relative to the spring leg. The support section of the actuation section can extend in this case from the actuation section toward the transition between the spring leg and the retaining leg and cooperate with the spring leg in a supporting manner at an end remote from the actuation section so that as a result, a pivot axis pointing through the support point is established for pivoting the spring leg.

In one embodiment, the retaining leg is bent around a first bending axis relative to the spring leg. In contrast, the actuation section is bent relative to the spring leg around a second bending axis that is transversely oriented relative to the first bending axis. From the actuation section, the support section preferably extends in the direction of the transition from the spring leg to the retaining leg.

The adjusting element can be designed, for example, as a lever element and can be arranged on the housing to pivot about a pivot axis. In this case, the adjusting element can have, for example, an operative section eccentric to the pivot axis with which the adjusting element acts upon the actuation section during an adjustment in order to thereby deflect the spring leg and adjust it between its clamping position and the release position.

FIGS. 1A, 1B to 4 show an exemplary embodiment of a connection device 1 which has a housing 10 with an insertion opening 100 formed thereon. An electrical conductor 2 can be plugged into the connection device 1 in a plug-in direction E, whereby the conductor 2 comes into engagement with the insertion opening 100 in order to electrically contact a contact section 130 of a current bar 13 inside the housing 10.

Formed on the power bar 13 is a terminal 132 to which a connector of an associated electrical assembly can be connected. The connection device 1 can, for example, be a component of an electrical installation, for example on a switchgear cabinet, and allow an electrical conductor 2 to be connected to the electrical installation.

A spring element 11 is enclosed in the housing 10 and is supported via a retaining leg 110 on a base 131 of the current bar 13 and has a spring leg 111 for locking an electrical conductor 2 inserted into the insertion opening 100. The spring element 11 engages in an associated housing receptacle 102 of the housing 10 with a bending section 116 at which the spring leg 111 is bent relative to the retaining leg 110 and is thereby enclosed within the housing 10.

The spring leg 111 is adjustable between different positions. The figures labeled "A" (FIGS. 1A, 2A and 3A) in this case each show the spring element 11 with the spring leg 110 in a clamping position in which a conductor 2 inserted into the insertion opening 100 is locked in the housing 10 and is additionally pressed into electrically contacting contact with the contact section 130 of the current bar 13. In contrast, the figures (FIGS. 1B, 2B and 3B) labeled "B" show the spring leg 111 in a release position in which the spring leg 111 is removed from the contact section 130 so that a conductor 2 inserted into the insertion opening 100 can be removed from the insertion opening 100, or an electrical conductor 2 can be inserted into the insertion opening 100 to contact the contact section 130 without great exertion of force.

The connection device 1 has an adjusting element 12 in the form of a lever element which is pivotably mounted on the housing 10 about a pivot axis 120. The adjusting element 12 has a handle section 121 that a user can manually grasp in order to adjust the adjusting element 12 relative to the housing 10. The adjusting element 12 acts on an actuation section 112 of the spring element 111 via an operative section 122, which is realized by an eccentric cam, in order to thereby pivot the spring leg 111.

Figure 4:
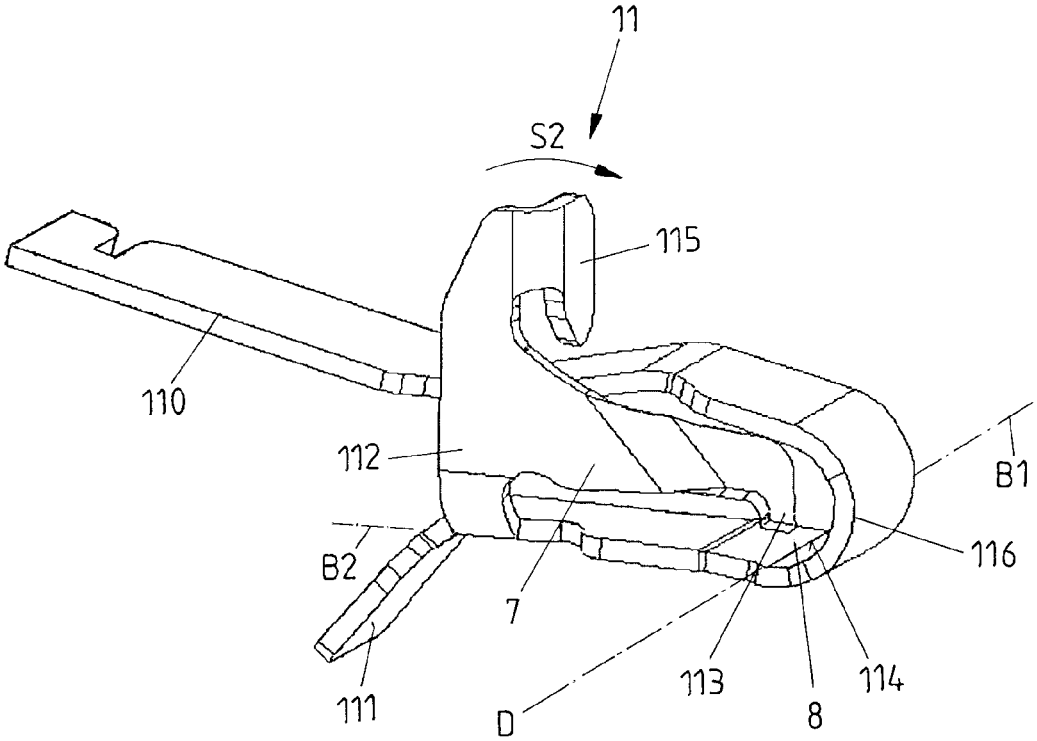
FIG. 4 a separate view of the spring element.

As can be seen from the separate view of the spring element 11 according to FIG. 4, the actuation section 112 projects from the spring leg 111 in the direction of the retaining leg 110 and is formed integrally with the spring leg 111. The spring element 11 is formed as a whole in one piece, for example from spring steel, and is inherently elastic.

The actuation section 112 is bent around a bending axis B2 relative to the spring leg 111. The bending axis B2 at the transition between the actuation section 112 and the spring leg 111 extends transversely to a bending axis B1 around which the spring leg 111 is bent relative to the retaining leg 110 at the bending section 116.

A surface section 115 is formed on the actuation section 112 and provides a contact surface for the operative section 122 of the adjusting element 12 so that, when the adjusting element 12 is pivoted, the operative section 122 acts on the surface section 115 and thereby generates leverage on the spring leg 111, as a result of which the spring leg 111 is pivoted out of the clamping position in the direction of the release position.

A support section 113 is formed on the actuation section 112 and extends from the actuation section 112 toward the bending section 116 at the transition between the spring leg 111 and the retaining leg 110 and thus projects from the actuation section 112 along the bending axis B2. The support section 113 is designed to bear against the spring leg 111 at a support point 114 when the adjusting element 12 acts on the surface section 115 in order to thereby establish a pivot axis D for pivoting the spring leg 111 out of the clamping position in the direction of the release position.

Figure 2A:
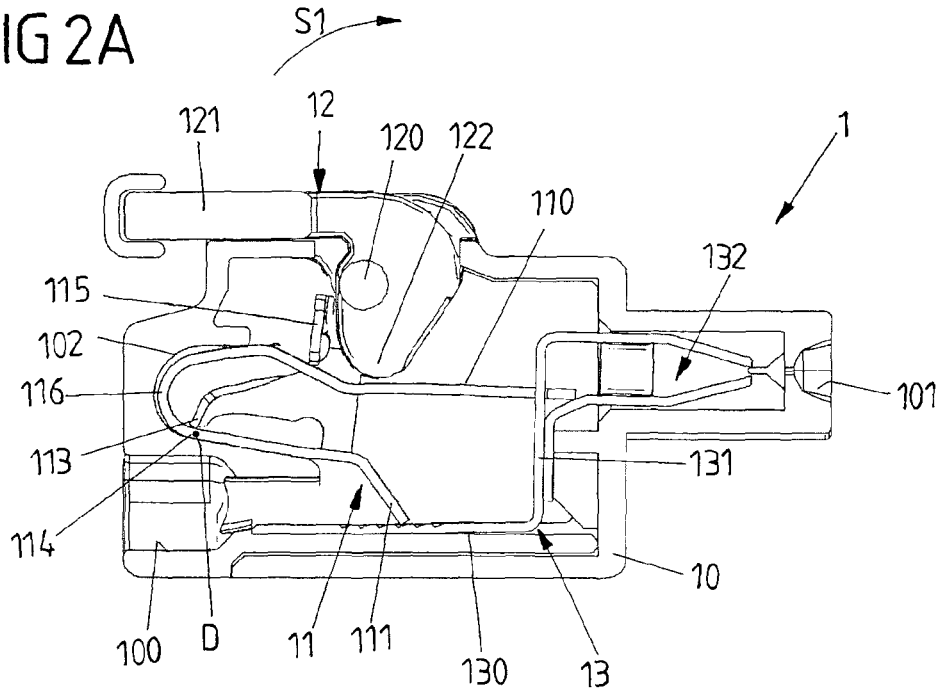
FIG. 2A a side view of the connection device with the spring element in the clamping position.
Figure 2B:
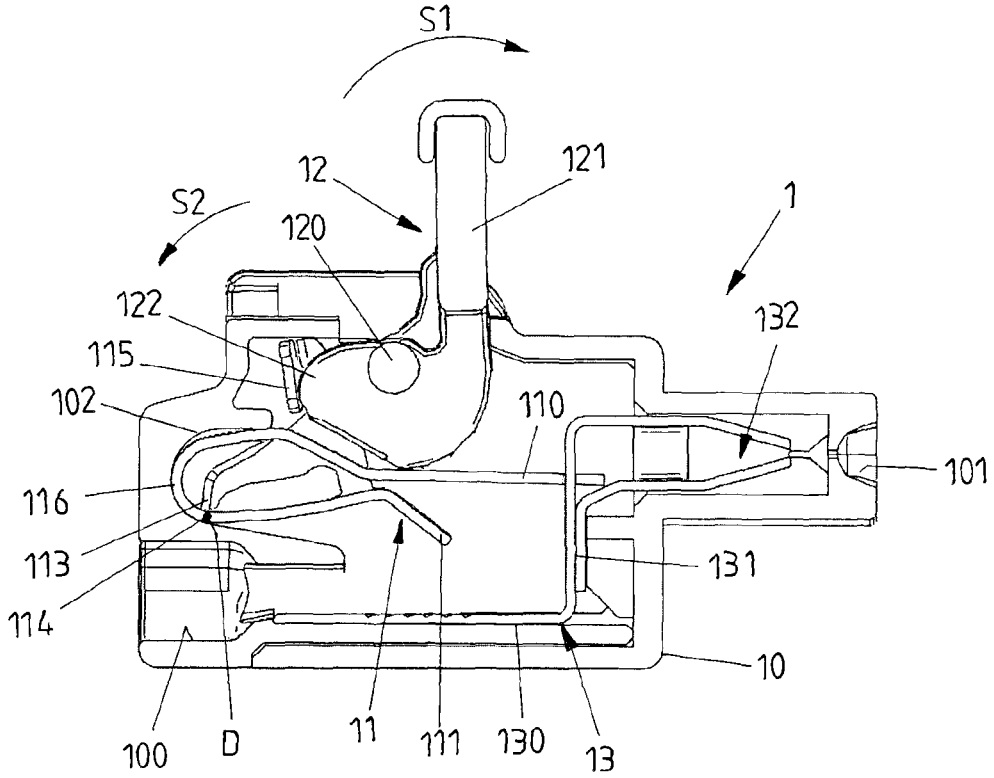
FIG. 2B the view according to FIG. 2A with the spring element in a release position.
Figure 3A:
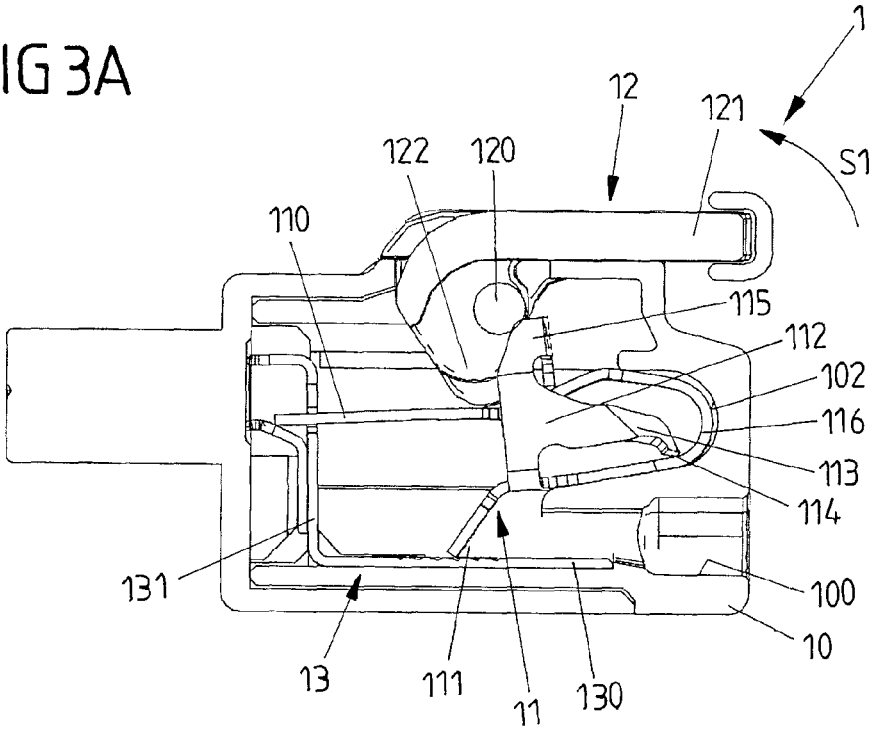
FIG. 3A a side view of the terminal device from the other side with the spring element in the clamping position.
Figure 3B:
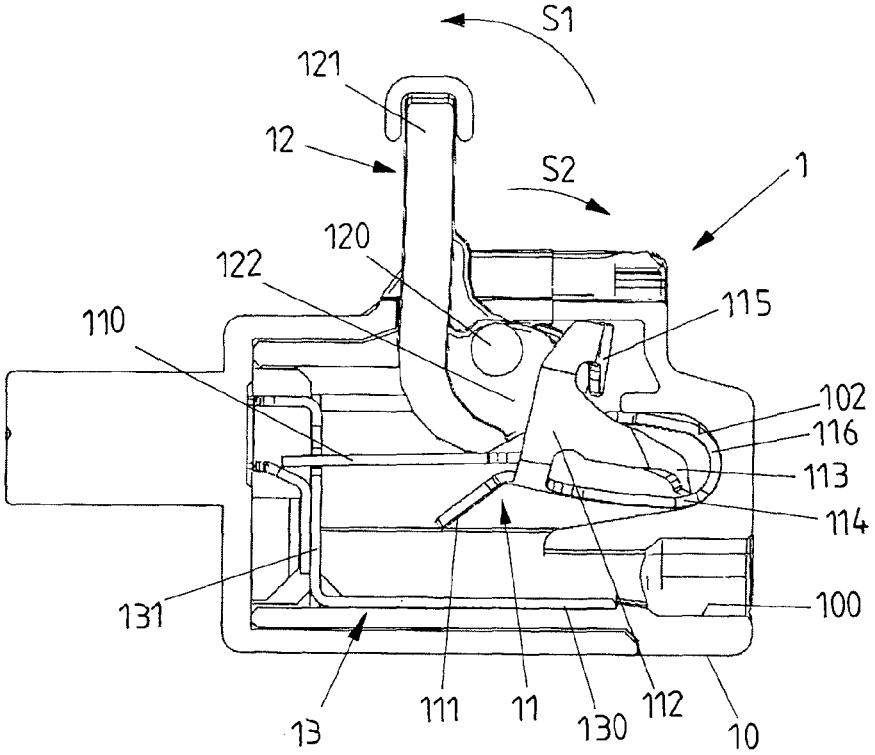
FIG. 3B the side view according to FIG. 3A with the spring element in the release position.

As can be seen from the transition, for example, from FIG. 2A to FIG. 2B, the adjusting element 12 for adjusting the spring leg 111 is pivoted about the pivot axis 120 out of the clamping position in the direction of the release position in a pivot direction S1. As a result, the operative section 122 of the adjusting element 12 presses on the surface section 115 so that leverage is generated in a pivot direction S2 on the spring leg 111. Due to the leverage, the support section 113 is pressed into contact with the spring leg 111 at the support point 114 so that a support for the spring leg 111 is created at the location of the support point 114, and the spring leg 111 is pivoted about the pivot axis D which points through the support point 114.

Because the spring leg 111 is pivoted out of its clamping position about a defined pivot axis D established by the support via the support section 113, a load is exerted on the spring leg 111 upon bending especially in the region of the pivot axis D, but less in other sections, especially in the region of the transition from the spring leg 111 to the actuation section 112. This makes it possible, as can be seen from the separate view of the spring element 11 according to FIG. 4 to reduce the width of the spring leg 111 at the location of the transition from the spring leg 111 to the actuation section 112, which makes it possible to keep the installation space of the spring element 11 small.

As can be seen from FIG. 4, in order to manufacture the spring element 11—especially to manufacture the actuation section 112 on the spring leg 111—it is necessary to bend the actuation section 112 relative to the spring leg 111. For this purpose, a relatively large bending radius is required which requires installation space in the transverse direction (along the direction of the bending axis B1). By reducing the dimensioning of the cross-sectional area of the spring leg 111 in the region of the transition between the spring leg 111 and the actuation section 112, the installation space in the transverse direction can be reduced so that the bending of the actuation section 112 does not result in enlargement of the total installation space taken up by the spring element 11 in the transverse direction.

By adjusting the adjusting element 12 for moving the spring leg 111 out of its clamping position, the spring leg 111 is tensioned. If the adjusting element 12 is then reset, the spring leg 111 automatically returns to the clamping position due to its elastic tension and clamps an electrical conductor 2 inserted into the insertion opening 100 within the housing 10 so that a (stripped) conductor end 20 of the conductor 2 is pressed into electrically contacting contact with the contact section 130.

The connection device 1 can also permit direct insertion of an electrical conductor 2 without having to actuate the adjusting element 12 for moving the spring leg 111 out of the clamping position. For this purpose, an electrical conductor 2, for example with a ferrule attached to the conductor end 20, can be inserted into the insertion opening 100 when the spring leg 111 is in the clamping position. As a result, the spring leg 111 is deflected due to the pressing action of the conductor 2 so that the support section 113 bears against spring leg 111 at the support point 114, and thus the spring leg 111 is pivoted about a defined pivot axis D.

The idea behind the invention is not limited to the exemplary embodiments described above but can also be realized in a completely different manner.

A connection device of the type described here can be used to connect an electrical conductor to any desired electrical assembly. In this case, the connection device can have a connection (additional to the spring force connection) for the connection of a plug connector. However, this is not mandatory. A current bar of the connection device can also be connected to an electrical assembly in some other way.

In the exemplary embodiment described here, the adjusting element for adjusting the spring element is pivotable. However, it is also conceivable and possible to displaceably arrange the adjusting element on the housing, for example.

In the described exemplary embodiment, the adjusting element exerts pressure on an actuation section on the spring leg. However, a coupling is also conceivable with which, for example, a tensile force is transmitted from the adjusting element to the spring leg.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Connection device
10 Housing
100 Insertion opening
101 Insertion opening
102 Housing receptacle
11 Spring element
110 Retaining leg
111 Spring leg
112 Actuation section
113 Support section
114 Support point
115 Surface section
116 Bending section
12 Adjusting element
120 Pivot axis
121 Handle section
122 Operative section
13 Current bar
130 Contact section
131 Base
132 Connection
2 Conductor
20 Conductor end
B1, B2 Bending axis
D Pivot axis
E Insertion direction
S1, S2 Pivot direction

The invention claimed is:

1. A connection device for connection of an electrical conductor, comprising:

a housing which has an insertion opening for insertion of an electrical conductor;

a spring element arranged on the housing, which spring element has a spring leg configured to lock the conductor inserted in the insertion opening; and an adjusting element which is arranged adjustably on the housing, wherein by adjustment of the adjusting element, the spring leg is movable between a clamping position in which the conductor inserted in the insertion opening is lockable in the insertion opening, and a release position in which the conductor may be inserted into the insertion opening, or the conductor inserted in the insertion opening is releasable from the insertion opening, wherein the spring element has an actuation section arranged on the spring leg, on which the adjusting element is configured to act during an adjustment for the movement of the spring leg, and on which a support section is formed, which is configured to bear against the spring leg at a support point when the spring leg is moved.

2. The connection device according to claim 1, wherein the adjusting element is configured to act on the actuation section in order to move the spring leg in a direction of the release position.

3. The connection device according to claim 1, wherein the support section is not in contact with the spring leg when the spring leg is in the clamping position, and bears against the spring leg at the support point when the spring leg moves in a direction of the release position.

4. The connection device according to claim 1, wherein the spring leg is pivotable relative to the housing about a pivot axis running through the support point by the support section making contact at the support point.

5. The connection device according to claim 1, wherein the actuation section is formed integrally with the spring leg.

6. The connection device according to claim 1, wherein the actuation section is bent relative to the spring leg.

7. The connection device according to claim 1, wherein the spring element has a retaining leg connecting to the spring leg and via which the spring element is held relative to the housing.

8. The connection device according to claim 7, further comprising a current bar which is arranged on the housing and which forms a contact section for contact with the conductor inserted into the insertion opening and against which the spring element is supported via the retaining leg.

9. The connection device according to claim 7, wherein the retaining leg is bent relative to the spring leg around a first bending axis, and the actuation section is bent relative to the spring leg around a second bending axis that is oriented transversely relative to the first bending axis.

10. The connection device according to claim 1, wherein the adjusting element is arranged on the housing to be pivotable about a pivot axis.

11. The connection device according to claim 10, wherein the adjusting element has an operative section eccentric to the pivot axis for acting on the actuation section of the spring element.

* * * * *